US006257135B1

(12) United States Patent
Dorton, Jr.

(10) Patent No.: US 6,257,135 B1
(45) Date of Patent: Jul. 10, 2001

(54) UNITARY SADDLE FOR MOUNTING MULTIPLE EMBOSS SLUGS ON A SINGLE EMBOSS ROLL

(75) Inventor: Howard L. Dorton, Jr., Statesboro, GA (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 09/294,057

(22) Filed: Apr. 19, 1999

(51) Int. Cl.[7] ..... B41F 1/07

(52) U.S. Cl. ..... 101/32; 101/23; 101/377; 101/378

(58) Field of Search ..... 101/23, 25, 28, 101/32, 377, 378, 381, 383, 384, 389

(56) References Cited

U.S. PATENT DOCUMENTS

| | | | | |
|---|---|---|---|---|
| Re. 16,777 | * | 10/1927 | Chisholm | 101/377 |
| 168,977 | * | 10/1875 | Firm | 101/378 |
| 811,776 | * | 2/1906 | Koehler | 101/377 |
| 852,786 | * | 5/1907 | Hodgman | 101/378 |
| 899,624 | * | 9/1908 | Sayre | 101/377 |
| 1,014,635 | * | 1/1912 | Brown | 101/23 |
| 1,282,923 | * | 10/1918 | Novotny | 101/378 |
| 2,169,676 | * | 8/1939 | Buck et al. | 101/378 |
| 3,309,984 | * | 3/1967 | MacKay | 101/23 |
| 3,603,255 | | 9/1971 | Horner . | |
| 3,603,256 | | 9/1971 | Franz et al. . | |
| 3,608,047 | | 9/1971 | Wiggins . | |
| 3,646,886 | | 3/1972 | Woessner et al. . | |
| 3,734,017 | | 5/1973 | Trier et al. . | |
| 3,775,231 | | 11/1973 | Thomas . | |
| 4,116,594 | | 9/1978 | Leanna et al. . | |
| 4,155,693 | | 5/1979 | Raley . | |
| 4,361,085 | | 11/1982 | Schutz . | |
| 4,402,265 | | 9/1983 | Pickard . | |
| 4,614,632 | | 9/1986 | Kezuka et al. . | |
| 5,356,506 | | 10/1994 | McNeil et al. . | |
| 5,505,125 | * | 4/1996 | Kapolner | 101/23 |

FOREIGN PATENT DOCUMENTS

| | | | | |
|---|---|---|---|---|
| 413270 | * | 7/1934 | (GB) | 101/37 |
| 851841 | | 10/1960 | (GB) . | |

* cited by examiner

*Primary Examiner*—Eugene Eickholt
(74) *Attorney, Agent, or Firm*—Finnegan, Henderson, Farabow, Garrett & Dunner

(57) ABSTRACT

The present invention is an apparatus for continuously embossing a moving web of material. More particularly, the present invention is a unitary saddle used to mount multiple embossing slugs to an emboss roll. The unitary saddle of the present invention improves slug alignment and thereby reduces the time the converting operation must be shut down for roll maintenance or the pattern changes.

32 Claims, 4 Drawing Sheets

UNITARY SADDLE FOR MOUNTING MULTIPLE EMBOSS SLUGS ON A SINGLE EMBOSS ROLL

FIELD OF THE INVENTION

The present invention relates to an apparatus for continuously embossing a moving web of material such as paper. More particularly, the invention relates to a unitary saddle for use on an emboss roll used in the embossing of paper and other products. Still more particularly, the invention relates to a mounting configuration free from prior art alignment problems. The invention finally relates to a method of continuously embossing a web, such as paper, with one or more embossing slugs which are mounted to a unitary saddle of the present invention.

BACKGROUND OF THE INVENTION

The present invention relates to apparatus used to emboss paper products, preferably elongate webs used to make paper goods, e.g., paper towels, toilet tissue, or paper napkins. Embossing is the act of mechanically working a substrate to cause the substrate to conform under pressure to the depths and contours of a patterned embossing roll. Generally, the web is passed between a pair of emboss rolls that, under pressure, form contours within the surface of the paper.

In most configurations at least one of the two roller surfaces directly carries the pattern to be transferred to the paper web. Known configurations include rigid-to-resilient embossing and rigid-to-rigid embossing.

In a rigid-to-resilient embossing system, a single or multi-ply substrate is passed through a nip formed between a roll whose substantially rigid surface contains the embossing pattern as a multiplicity of protuberances and/or depressions arranged into an aesthetically-pleasing manner, and a second, roll, whose substantially resilient surface can be either smooth or also contain a multiplicity of protuberances and/or depressions which cooperate with the rigid surfaced patterned roll. Commonly, rigid rolls are formed with a steel body which is either directly engraved upon or which can contain a hard rubber-covered surface (directly coated or sleeved) upon which the embossing pattern is laser engraved. The resilient roll may consist of a steel core directly covered or sleeved with a resilient material such as rubber. The rubber coating may be either smooth or engraved with a pattern. The pattern on the resilient roll may be either a mated or a non-mated pattern with respect to the pattern carried on the rigid roll.

In the rigid-to-rigid embossing process, a single-ply or multi-ply substrate is passed through a nip formed between two substantially rigid rolls. The surfaces of both rolls contain the pattern to be embossed as a multiplicity of protuberances and/or depressions arranged into an aesthetically-pleasing manner where the protuberances and/or depressions in the second roll cooperate with those patterned in the first rigid roll. The first rigid roll may be formed, for example, with a steel body which is either directly engraved upon or which can contain a hard rubber-covered surface (directly coated or sleeved) upon which the embossing pattern is laser engraved. The second rigid roll can be formed with a steel body or can contain a hard rubber covered surface (directly coated or sleeved) upon which a matching or mated pattern is conventionally engraved or laser-engraved.

Prior art embossing systems where the embossing pattern is carried directly by one or both of the embossing rolls suffer from a number of disadvantages. Specifically, if the emboss pattern gets damaged or if the pattern becomes fouled with, for example, foreign matter, the emboss process must be interrupted while the roll is cleaned or repaired. Another emboss roll may need to be installed if, for example, the roll is damaged to a point that the pattern must be reground or retooled.

Expense can also be a significant factor in processes requiring a periodic change in the embossing pattern. Such periodic changes can be very expensive if the pattern is applied directly to the roll, since any change in pattern requires that a completely new roll be installed. Installation of a new roll requires that the converting operation be shut down for a time sufficient to complete the roll change. As discussed above, the amount of time that the converting line must be shut down can have a significant impact on productivity, and thereby cost.

Other problems with typical prior art rolls include uneven wear patterns on the emboss rolls. These uneven patterns either require that the roll be replaced and reground or that for a period of time the converting operation be continued with emboss definition in the cross-machine direction of the web which is uneven and/or unreliable.

Thus, there is an advantage to a system having emboss pattern elements that are not integral with the roll and which can more easily be removed and changed in the event of damage or fouling. Such a system is also advantageous for products which may, for any reason, require frequent pattern changes.

Systems having non-integral elements are known. These systems are most frequently used in print technology, but have expanded over time to include embossing systems. The prior art embossing systems typically include a holding roll and a carrier for the emboss pattern. The carrier for the emboss pattern can take several configurations, the most common of which are sleeves, flexible plates or saddles.

A sleeve completely encircles the embossing roll and thus, suffers from a number of the drawbacks discussed above, including, for example, expense and difficulty in changing. The flexible plate and saddle configurations address the drawbacks of engraved rolls and sleeves by using a flexible plate or an inflexible curved plate (saddle) that does not completely encase the embossing roll.

Systems that use flexible plates or saddles are known to have two basic attachment configurations. The first is a mechanical system whereby the embossing plates or saddles are mechanically mounted to a holding roll, see for example, U.S. Pat. Nos. 3,646,886 and 3,603,256. Mechanically attaching a flexible emboss plate directly to the roll suffers from a number of disadvantages. These disadvantages include difficulty in changing the embossing plates due to space limitations between the roll and the attachment means. Further, the mechanical attachment means has to be configured so that it does not show or does not interfere with the embossing pattern.

Due to problems associated with mechanically attaching an embossing plate to an embossing roll, one solution has been to use a saddle and slug configuration. The saddle is an inflexible curved plate that carries a single slug. The slug is an engraved plate that carries the desired embossing pattern. The slug is mounted onto the saddle and thus, mechanical attachment means can be more easily configured so that they do not interfere with the embossing pattern.

The second system improves upon the ease of the mechanical system by using a magnetic holding system. This type of system is exemplified in U.S. Pat. No. 4,116, 594. Most magnetic systems use a series of flexible plates that are directly mounted to the embossing roll. Magnetic systems are believed to have two advantages over the mechanical system: (1) the ease with which the embossing plates or saddles can be removed and replaced, and (2) the ability to cover the entire surface of the embossing roll to creating a continuous pattern which is not interrupted due to space for mechanical attachment means.

While both prior systems have had limited success, none of the systems provides a truly easy means for changing the saddles or flexible plates. In the mechanical systems, the plates must be removed and replaced which, depending upon the complexity of the hold mechanism, can cause significant down time for the converting line. Furthermore, even if a saddle/slug configuration were used, if more than a single slug and saddle were used, each slugs and saddle had to aligned both vertically and horizontally. In the magnetic systems, while the saddles or plates could be more easily removed, if more than a single plate or saddle were removed, replacement of the plates results in alignment problems that could result in significant down time for the converting line.

The present invention addresses these problems by providing a single unitary saddle that can hold one or more embossing slugs, thus providing a simple mechanical holding means that can be as easy to change as prior magnetically held plates without the concomitant problems associated with alignment. Such a system allows the slugs to be aligned off the embossing machine, while the system is still in operation. Once the converting line is stopped, the saddle can be quickly removed and a new saddle quickly added. The unitary saddle of the present invention can then be adjusted horizontally and vertically, while maintaining the relative arrangement of the slugs that carry the emboss patterns. The system according to the present invention allows for embossing slugs which are sized to cover the entire web surface with a continuous pattern or which are discrete elements that can be used to create registered patterns, for example, logos.

Further advantages of the invention will be set forth in part in the description which follows and in part will be apparent from the description or may be learned by practice of the invention. The advantages of the invention may be realized and attained by means of the instrumentalities and combinations particularly pointed out in the appended claims.

SUMMARY OF THE INVENTION

To achieve the foregoing advantages and in accordance with the purpose of the invention, as embodied and broadly described herein, there is disclosed:

An apparatus for embossing a web of material including at least one emboss roll having a cylindrical surface; at least one saddle releasably and mechanically secured to the cylindrical surface; and at least two emboss slugs releasably and mechanically secured to the saddle.

There is further disclosed:

A saddle for use with a roll for continuously embossing a web including a semi-cylindrical surface having mechanical fastening means associated therewith for securing the saddle to an embossing roll and wherein the surface of the saddle contains a plurality of tapped holes for mechanically and releasably securing at least two emboss slugs to the semi-cylindrical surface.

There is still further disclosed:

A method of embossing a paper product including passing a web of paper between two embossing rolls, at least one of the rolls having mechanically and releasably attached to its surface, at least one saddle, where the saddle contains at least two emboss slugs that are mechanically and releasably attached to the surface of the saddle.

Finally, there is disclosed:

An apparatus for embossing a web of material including at least one emboss roll having a cylindrical surface; at least one saddle releasably and mechanically secured to the cylindrical surface; and at least one emboss slug having a registered pattern thereon which is releasably and mechanically secured to the saddle.

The accompanying drawings, are included to provide a further understanding of the invention and are incorporated in and constitute a part of the specification. The drawings illustrate embodiments of the invention and, together with the description, serve to explain the principles of the invention.

DETAILED DESCRIPTION

In the production of paper products it is known to emboss sheets comprising one or more plies of creped paper, e.g., tissue, towel or napkin to increase the surface area of the sheets thereby enhancing their bulk and moisture holding capacity. Continuous embossing generally uses a pair or opposed embossing rolls. At least one of the opposed rolls carries the pattern which is to be applied to a surface of the product. In a continuous embossing process, a web of the product to be embossed, e.g., paper, is fed between the rolls which engage one another under pressure. This engagement causes the pattern from the roll to be transferred to the moving web. Highly defined emboss patterns are desirable for their aesthetic appearance.

Emboss definition refers to the contrast between adjacent surfaces created as a result of shadowing. Shadowing is created by relative elevations between the surfaces of a paper web and the abruptness of the change in elevation or topography between the surfaces. Generally, as a web is passed through an emboss nip, some areas of the web in the pattern experience higher levels of densification. Increased densification and opacity created at the top of a protuberance tends to improve the definition of the embossing pattern by enabling the structure to hold its shape. The relative reflectivity and opacity of the surfaces of the web also contribute to the intensity of the shadowing effect which results in improved emboss definition.

The present invention relates to an apparatus and method for securing a pattern to an emboss roll which is used in connection with continuous embossing of a web of product. According to the present invention, a unitary saddle, is mechanically and releasably attached to an emboss roll. As used in the present invention, saddle refers to a member with supports and holds one or more emboss slugs which are used to carry and transfer the pattern to the paper web.

The saddle of the present invention is sized and shaped to accommodate the relative size of the web to be embossed, the size of the embossing roll, or both. According to the present invention a unitary saddle is used, regardless of the number of embossing slugs, thus minimizing or eliminating the amount of online vertical and horizontal adjustment that must be carried out.

Figure 4:
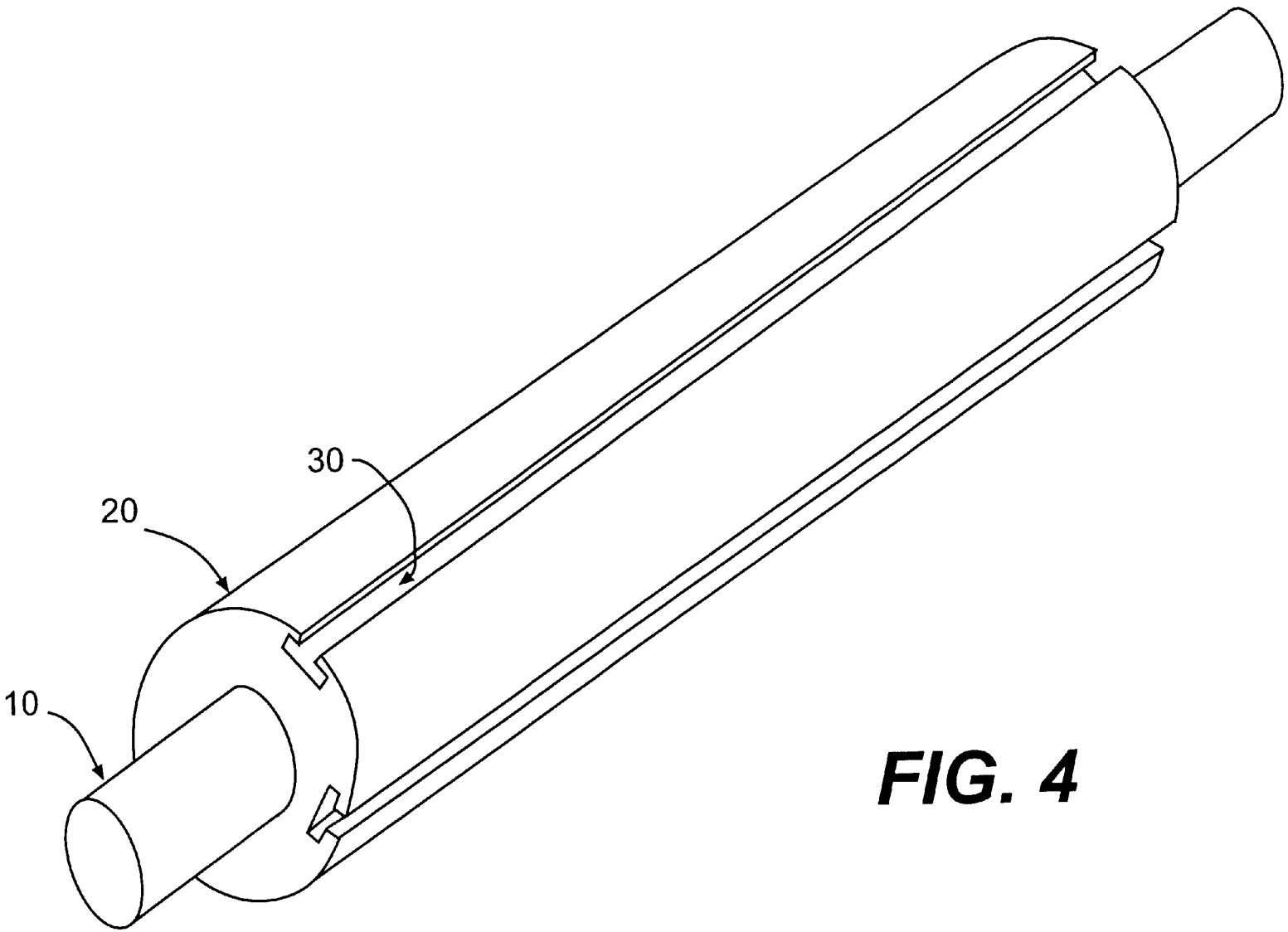
FIG. 4 illustrates an emboss roll with a turn key slot for saddle attachment, but without a saddle attached.

Embossing saddles for use according to the present invention are shaped to correspond to the embossing roll to which they will be attached. Typically, the saddle is semi-cylindrical and follows the arc of the embossing roll. An emboss roll according to a preferred embodiment of the present invention is illustrated in FIG. 4. The emboss roll 20 as shown, is circular. The roll 20 as shown has two turn key slots 30 for attaching a saddle using T-nuts (not shown) that can slide into the turn key slots 30.

Embossing rolls for use according to the present invention range from about 15 inches to about 56 inches. More preferably, the rolls for use according to the present invention are from 28 to 34 inches in width, most preferably, the saddle according to the present invention is 27 inches wide. The average diameter of the embossing roll is from about 2 to about 25 inches, more preferably from about 3 to about 15 inches, and most preferably from about 3 to about 11 inches. Selection of the appropriate shape and length of the saddle would be apparent to the skilled artisan based upon the width of the web to be embossed, the shape and width of the embossing roll and the number of discrete embossing slugs that must be mounted onto the saddle.

While a single unitary saddle spans the width of the roll, the circumference of the roll may contain as many saddles as may be physically present around the roll. Typically a roll will contain 8 saddles or less. In a preferred embodiment, the roll contains from 1 to 2 saddles. When a plurality of saddles are used, the saddles are preferably located at even intervals around the roll; however, the saddles may be at any position that will satisfy the required placement of the pattern on the embossed product. When a plurality of saddles are used, the saddles are preferably located at 90° or 180° degree intervals around the role.

The unitary saddle is attached to the embossing roll by any art recognized means for mechanically attaching a saddle. In one preferred embodiment, the embossing structure of this invention relates to a standard emboss roll having standard undercut T-shaped key-slots cut into its peripheral (cylindrical) surface. Other mechanical attachment means including, for example, bolting without key slots, spring loaded hooks, vice grips, and hose clamps, will be readily apparent to the skilled artisan. Any art recognized mechanical attachment means can be used in the present invention.

The numbers of turn slots that can be cut into the base embossing roll range from one to as many as can be physically located around the roll. Multiple turn key slots located at spaced locations around the roll allow for greater variations in the placement of saddles around the roll, thus, resulting in accommodation of a greater number of possible emboss pattern variations. The turn-key slots are preferably between 4 and 16 per roll, more preferably between 4 and 8 turn-key slots per roll. The saddles are connected to the rolls by T-nuts that are inserted into the turn-key slots. Bolts can then be inserted through the saddles, into the T-nuts, and tightened to secure the saddle in place.

The saddle according to the present invention is constructed of a durable material that can withstand repeated use. Appropriate materials include steel, brass, and the like. The embossing slugs for use in concert with the unitary saddle are preferably constructed of any material that is sufficiently durable that can also be patterned. Appropriate materials include, for example, steel, magnesium, plastics including photopolymer and high durometer rubbers.

Patterning of the emboss slugs can be carried out by any currently art recognized method or other developed method. Appropriate patterning means include grinding, etching, laser engraving and patterning with light, e.g., when using a photopolymer. Alternative patterning means will be readily apparent to the skilled artisan.

The apparatus according to the present invention using a mechanical means for attaching an embossing plate or slug to the unitary saddle. Typically, the embossing slug is bolted to the unitary saddle. In one preferred embodiment, the saddle contains a number of predrilled prealigned tapped holes 60 that allow for the attachment of different size slugs depending upon the pattern that one wishes to transfer. According to this embodiment, the saddle can have as may as 4 or 5 tapped holes 60 per inch. The tapped holes 60 may take any pattern that will allow the emboss slugs to be attached as required to create any registered or unregistered pattern. The tapped holes 60 are used to secure the slug to the saddle. The saddle contains both tapped holes 60 and through holes 70. The through holes 70 are for securing the saddle to the roll. A T-nut is inserted into the turn key slot and a bolt is inserted through a hole 70 on the saddle and tightened.

The saddle according to the present invention can contain from 1 to 8 slugs, more preferably, the saddle contains from 2 to 8 slugs and in preferred embodiments, the saddle accommodates 3, 4, 6 or 8 slugs.

Registered patterns are those which are spatially aligned on the elongate web so that they will appear in a proper location on the finished product. The present invention can be used with registered or unregistered patterns. The present invention is preferably used with registered patterns. The web may be embossed with any art recognized embossing pattern, including, but not limited to, overall emboss patterns, spot emboss patterns, micro emboss patterns, which are patterns made of regularly shaped elements or combinations of overall, spot, and micro emboss patterns.

The web may be embossed by one or more sets of embossing rolls. In one embodiment, a first set of embossing rolls may create an overall pattern, while a second set of rolls creates an overlaid pattern. In another embodiment, the first rolls may apply a first registered pattern, e.g., a logo, while the second set of rolls may apply an overall pattern. Individual registered patterns appearing on the same product may be embossed using separate sets of emboss rolls. Alternatively, all registered patterns may appear on different slugs on one or more saddles on the same roll. This embodiment may be used, for example, to put logo information of the front of a finished napkin and a recycled material stamp on the reverse.

Figure 1:
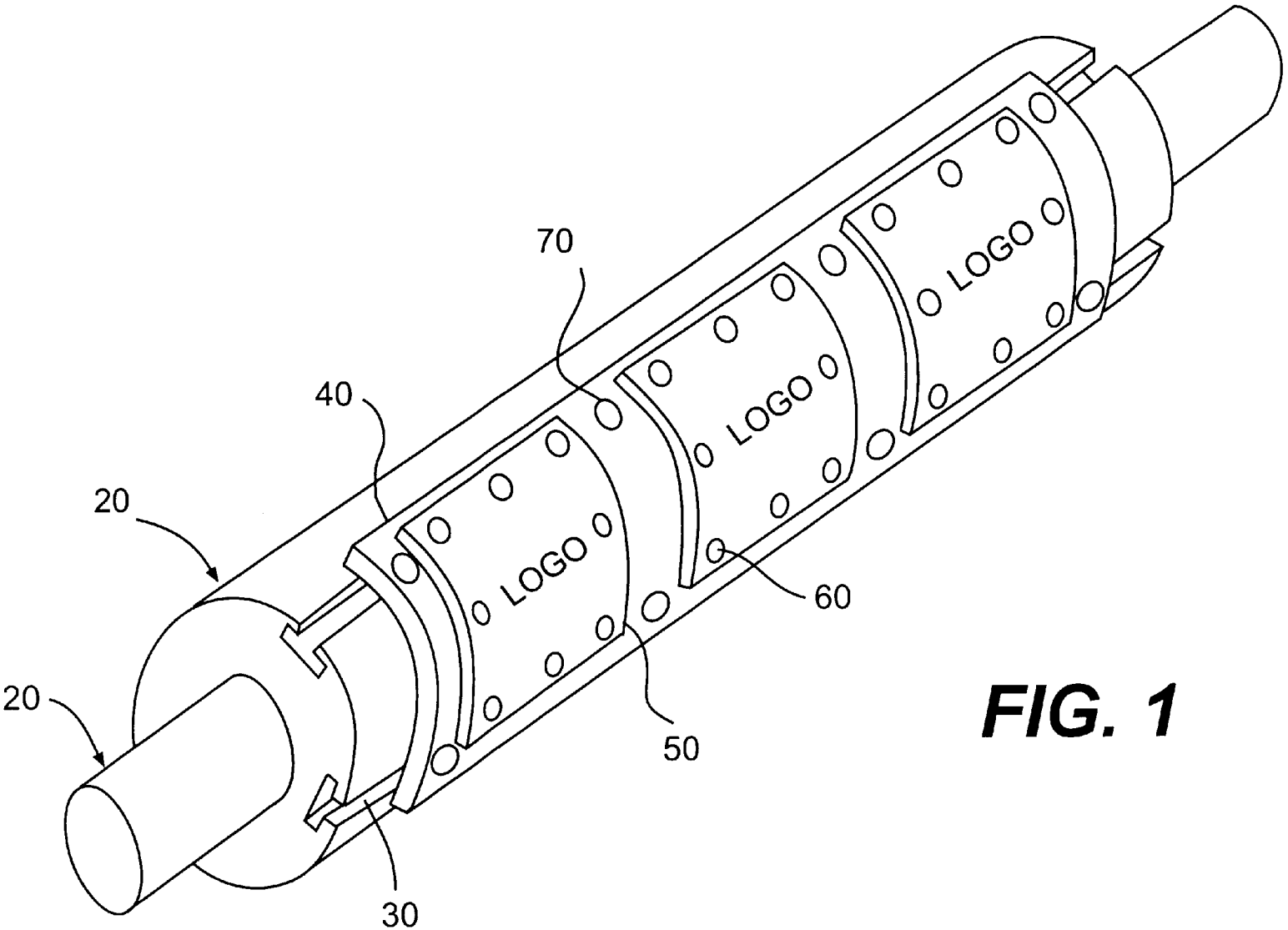
FIG. 1 illustrates an emboss roll having a unitary saddle according to the present invention and three emboss slugs.
Figure 3:
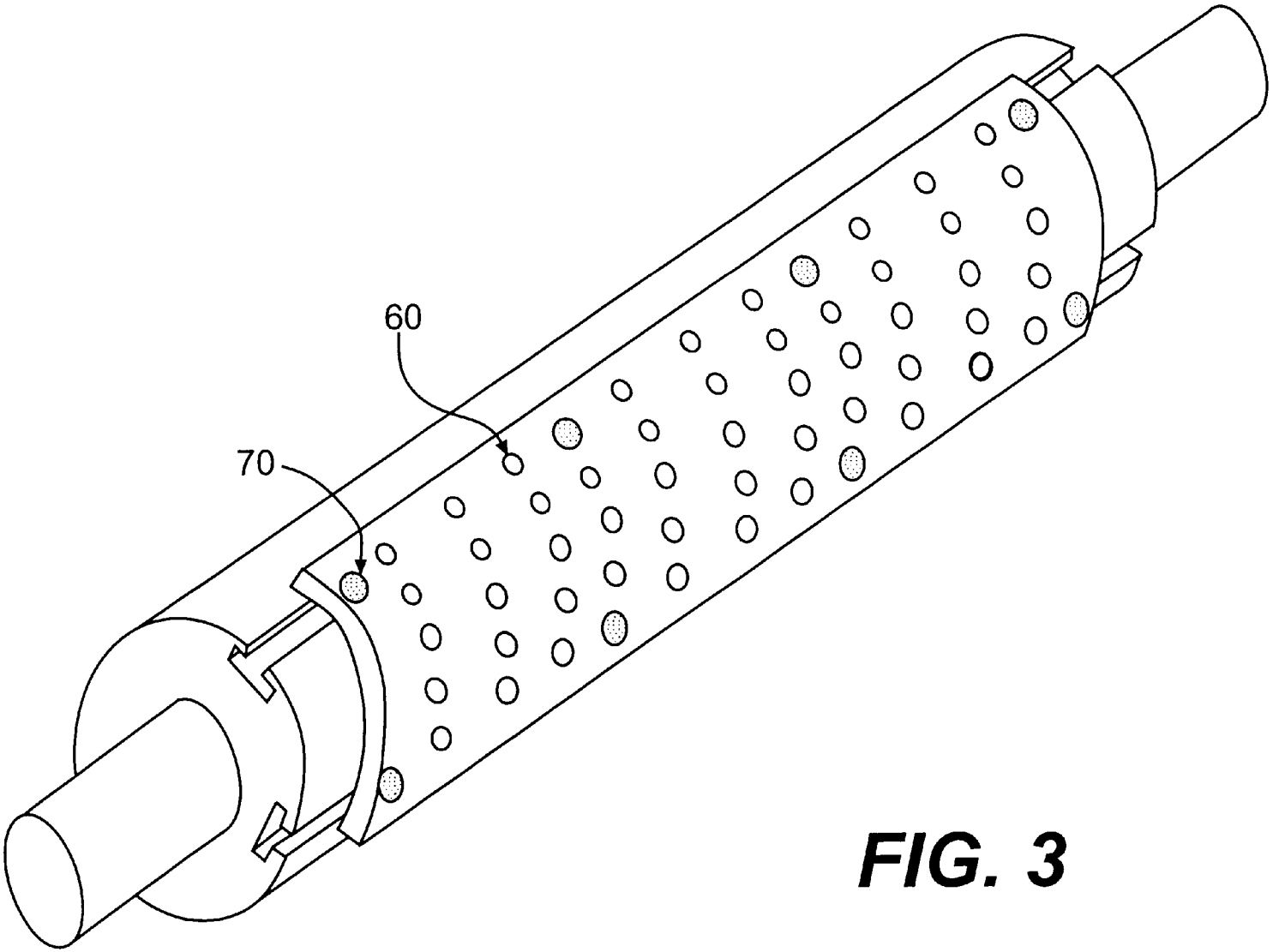
FIG. 3 illustrates an emboss roll having a unitary saddle without slugs attached.

One preferred embodiment of the saddle according to the invention is shown in FIGS. 1 and 3. In this preferred embodiment, the saddle 40 is attached to the roll 20 by sliding the T-nuts (not shown) into turn key slots 30. The saddle is secured to the roll 20 by the bolts 70. Three embossing slugs 50 are depicted in FIG. 1 as secured to the saddle 40 by bolts 60.

When the present invention is used with an embossing nip, the invention can be used with any art recognized emboss configuration. Appropriate emboss configurations include dual or multi-roll and single or multi-nip embossing systems. The embossing configurations are preferably rigid-to-resilient or rigid-to-rigid systems.

Variation or combination of the rigid-to-resilient and/or rigid-to-rigid embossing processes are well understood by the skilled artisan and could be appropriately used in conjunction with the present invention. For example, nested embossing, point-to-point embossing, and multi-nip embossing processes are also within those configurations appropriate for use with the present invention. See for example, U.S. Pat. Nos. 5,093,068, 5,091,032, 5,269,983 and 5,030,081 to Galyn A. Schulz.

In some instances, the pattern may be present on one roll and the relief of that pattern may be on the opposed roll. This is referred to as mated or matched embossing. In one embodiment of the present invention, the pattern in a steel roll may be transferred to a fiber roll under pressure. The steel roll and the matched fiber roll then form a nip for embossing the paper product.

Figure 2:
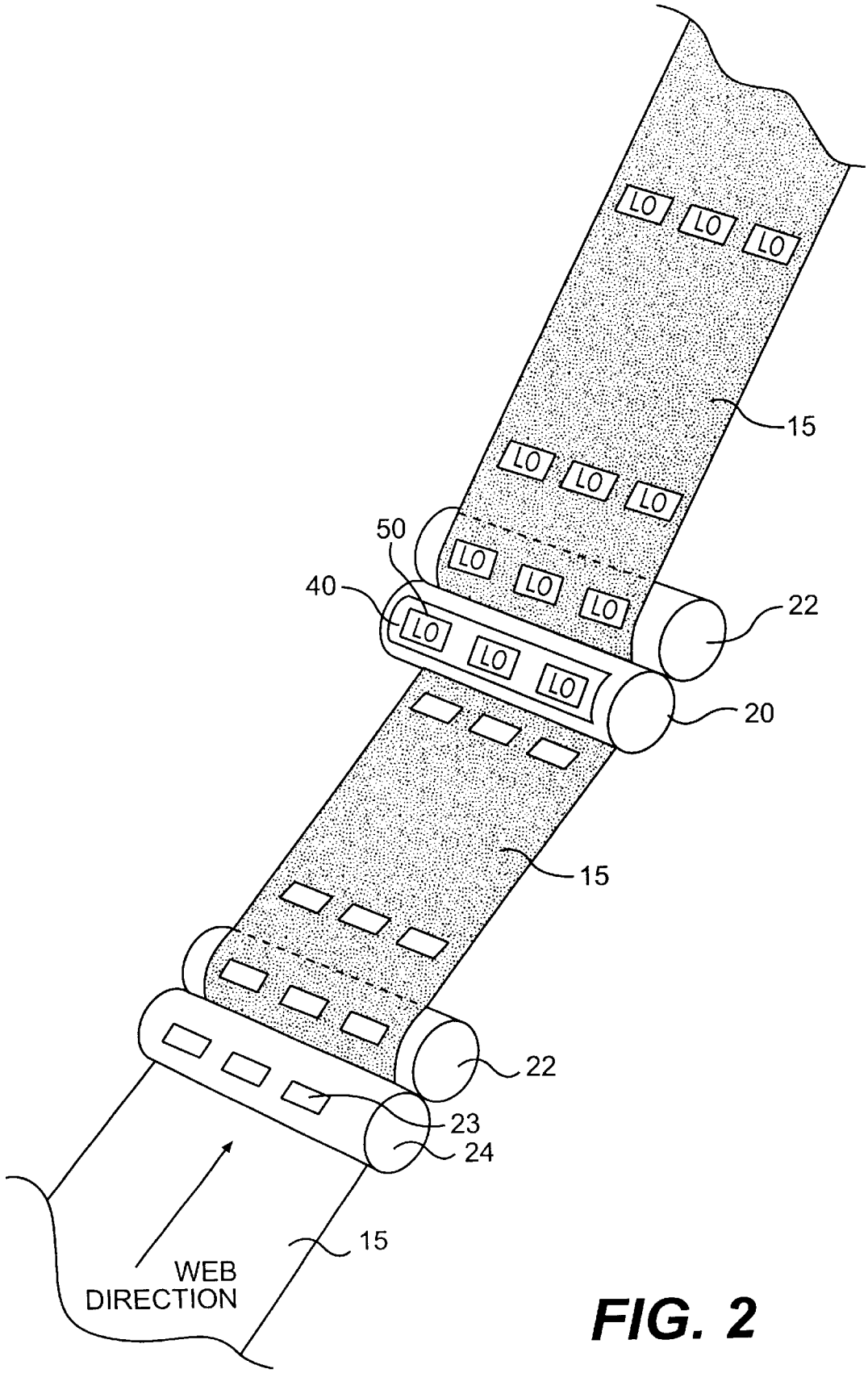
FIG. 2 illustrates two pairs of emboss rolls and a length of web being embossed.

One preferred emboss process according to the present invention is depicted in FIG. 2. FIG. 2 shows a web 15 which passes between a background emboss roll 24 which contains an overall pattern and logo windows 23 and a matched emboss roll 22. After passing between these rolls, the web has an overall background pattern and windows into which logo, pattern, or signature emboss material may be placed. Signature bosses refer to material embossed on a paper product that would allow the consumer to associate the product with the manufacturer. The windows must be aligned as the web passes between a second set of rolls which adds the logo or signature emboss material. This arrangement is referred to as a registered embossing pattern.

The second set of rolls includes a steel mandrel logo roll 20 and a matched roll 22. The steel mandrel roll 20 has a saddle according to the present invention 40 and has three emboss slugs 50 attached to the saddle. The slugs are aligned so that as the web passes between the rolls 20, 22 the windows 23 coincide with the slugs 50. By this arrangement, passage of the web between the second set of rolls 20,22 results in a web having an overall pattern and having a logo or signature embossment at discrete locations.

In the production of paper napkins, for example, the web will be severed and folded so that the logo or signature information preferably appears on the front of the product. Additional slugs and/or logos can be added to the napkin which might appear for instance on the reverse side of the napkin.

The saddle according to the present invention reduces the amount of time the converting operation must be down in order to make necessary changes when a slug is damaged or the emboss pattern is required to be changed. According to the present invention, while the system is being run, a second saddle or set of saddles may be prepared with the appropriate emboss slugs for changeover of the system. Once the slugs have been added to the saddle in an aligned configuration, the system can be stopped and the first saddle removed and the second saddle added. Regardless of the number of emboss slugs that are needed in the configuration, a single adjustment of the saddle can result in perfect horizontal and vertical alignment of all slugs. Furthermore, the entire saddle need be adjusted only once to assure the registered pattern will align with the windows provided in the overall pattern and as exemplified in FIG. 2. Alignment of a single saddle results in upwards of a 50% to 80% improvement in down times realized for changing of emboss slugs or saddle/slug combinations.

The following examples are illustrative of, but are not to be construed as limiting the invention embodied herein.

EXAMPLES

A napkin was produced which contained an overall emboss pattern and a registered pattern on the front of the napkin.

Two unitary saddles each having bolted thereon four emboss slugs were mounted on an emboss roll according to the present invention using standard bolts. The two saddles were mounted on a roll with T-nuts by sliding them into T-shaped key ways and then securing the saddles using standard bolts. The two saddles were mounted on the roll in 180° relationship to one another.

Two pairs of steel rolls or one steel roll and one fiber roll having an overall pattern and including windows for the registered pattern were used to create embossing nips. An embossed paper web was produced by running the web between the first pair of rolls for overall embossing. The web was then passed between the second pair of rolls, one roll having a saddle according to the present invention with four embossing slugs. Each of the embossing slugs contained a pattern which was transferred to the windows left in the overall pattern that was applied to the paper web. This type of embossing requires registration between the rolls used to emboss the overall pattern and those used to add the registered embossments, since these registered embossments need to be aligned to fall directly within the windows left on the paper web by the roll containing the overall pattern.

The paper web was then further converted by severing and folding to create the finished napkin product.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

I claim:

1. An apparatus for embossing a web of material comprising:

at least one emboss roll having a cylindrical surface with relief contours formed thereon;

at least one saddle releasably and mechanically secured to said cylindrical surface; and at least two emboss slugs prealigned and releasably and mechanically secured to said saddle, wherein the emboss roll, saddle and slugs are sized and configured to cooperate and apply the relief contours of the emboss roll to the web of material to emboss the web of material.

2. The apparatus according to claim 1, wherein at least three embossing slugs are releasably and mechanically secured to said at least one saddle.

3. The apparatus according to claim 2, wherein at least four embossing slugs are releasably and mechanically secured to said at least one saddle.

4. The apparatus according to claim 3, wherein at least six embossing slugs are releasably and mechanically secured to said at least one saddle.

5. The apparatus according to claim 4, wherein at least eight embossing slugs are releasably and mechanically secured to said at least one saddle.

6. The apparatus according to claim 1, wherein the emboss roll is between 15 and 56 inches wide.

7. The apparatus according to claim 6, wherein the emboss roll is 27 inches wide.

8. The apparatus according to claim 1, wherein the emboss roll contains a plurality of turn key slots.

9. The apparatus according to claim 8, wherein said at least one saddle has through holes for securing said at least one saddle to said at least one embossing roll.

10. The apparatus according to claim 1, wherein said at least one saddle contains holes for securing said at least two embossing slugs to said at least one saddle.

11. The apparatus according to claim 1, wherein said at least one embossing roll has at least two saddle mechanically and releasably secured thereto.

12. The apparatus according to claim 11, wherein said at least two saddles are spaced evenly around said at least one embossing roll.

13. A saddle for use with a roll for continuously embossing a web comprising:

a semicylindrical surface having mechanical fastening means associated therewith for securing the saddle to an embossing roll having relief contours formed thereon and wherein the surface of the saddle contains a plurality of holes for mechanically and releasably securing and prealigning the at least two emboss slugs to said semi-cylindrical surface and wherein the embossing roll, saddle and slugs are sized and configured to cooperate and apply the relief contours formed on the embossing roll to the web to emboss the web.

14. The saddle of claim 13, wherein the saddle contains at least two emboss slugs mechanically secured to the surface thereof.

15. The saddle according to claim 13, wherein said plurality of holes for securing said at least two emboss slugs are tapped holes.

16. The saddle of claim 13, wherein said saddle includes a mechanical fastening means for securing said saddle to an emboss roll.

17. The saddle of claim 16, wherein said fastening means are a series of through holes.

18. A method of embossing a paper product comprising:

passing a web of paper between two embossing rolls having relief contours formed thereon, at least one of said rolls having mechanically and releasably attached to the surface thereof at least one saddle, wherein said at least one saddle contains at least two emboss slugs that are prealigned and mechanically and releasably attached to the saddle and wherein the embossing rolls, saddle and slugs are sized and configured to cooperate and apply the relief contours formed on the embossing rolls to the paper product to emboss the paper product.

19. The method according to claim 18, wherein said at least two emboss slugs have registered patterns thereon.

20. An apparatus for embossing a web of material comprising:

at least one emboss roll having a cylindrical surface with relief contours formed thereon;

at least one saddle releasably and mechanically secured to said cylindrical surface; and at least one emboss slug having a registered pattern thereon which is prealigned and releasably and mechanically secured to said saddle, wherein the emboss roll, saddle and slug are sized and configured to cooperate and apply the relief contours of the emboss roll to the web of material to emboss the web of material.

21. The apparatus according to claim 20, wherein at least two embossing slugs are releasably and mechanically secured to said at least one saddle.

22. The apparatus according to claim 21, wherein at least three embossing slugs are releasably and mechanically secured to said at least one saddle.

23. The apparatus according to claim 22, wherein at least four embossing slugs are releasably and mechanically secured to said at least one saddle.

24. The apparatus according to claim 23, wherein at least six embossing slugs are releasably and mechanically secured to said at least one saddle.

25. The apparatus according to claim 24, wherein at least eight embossing slugs are releasably and mechanically secured to said at least one saddle.

26. The apparatus according to claim 20, wherein the emboss roll is between 15 and 56 inches wide.

27. The apparatus according to claim 26, wherein the emboss roll is 27 inches wide.

28. The apparatus according to claim 20, wherein the emboss roll contains a plurality of turn key slots.

29. The apparatus according to claim 28, wherein said at least one saddle has through holes for securing said at least one saddle to said at least one embossing roll.

30. The apparatus according to claim 20, wherein said at least one saddle contains holes for securing said at least two embossing slugs to said at least one saddle.

31. The apparatus according to claim 20, wherein said at least one embossing roll has at least two saddle mechanically and releasably secured thereto.

32. The apparatus according to claim 31, wherein said at least two saddles are spaced evenly around said at least one embossing roll.

* * * * *